United States Patent [19]

Sayles et al.

[11] 3,984,306

[45] Oct. 5, 1976

[54] PINCHED SLUICE SEPARATORS

[75] Inventors: Charles Philip Sayles, Caterham; Cyril Hart, Sketty, both of England

[73] Assignee: Dryflo Separators Limited, Barking, England

[22] Filed: Jan. 27, 1975

[21] Appl. No.: 544,387

[30] Foreign Application Priority Data

Jan. 25, 1974 United Kingdom ..... 3540/74

[52] U.S. Cl. ..... 209/20; 209/136; 209/144; 209/474; 209/494; 302/29

[51] Int. Cl.[2] ..... B07B 9/00

[58] Field of Search ..... 209/484, 490, 494, 142, 209/143, 136, 137, 115, 119, 120, 18, 20, 132, 133–135, 144, 459, 474; 302/29

[56] References Cited

UNITED STATES PATENTS 3,773,172 11/1973 McClure et al. ..... 209/74 X

FOREIGN PATENTS OR APPLICATIONS 1,153,722 5/1969 United Kingdom ..... 209/494

*Primary Examiner*—Robert B. Reeves
*Assistant Examiner*—Joseph J. Rolla
*Attorney, Agent, or Firm*—Darby & Darby

[57] ABSTRACT

Granular materials are separated on a dry pinched sluice separator having at its discharge end a conical concave surface. The material to be separated is allowed to flow downwardly over the separator chute under gravity and fluidization and the so separated materials traverse the concave surface.

10 Claims, 2 Drawing Figures

Figure 1:
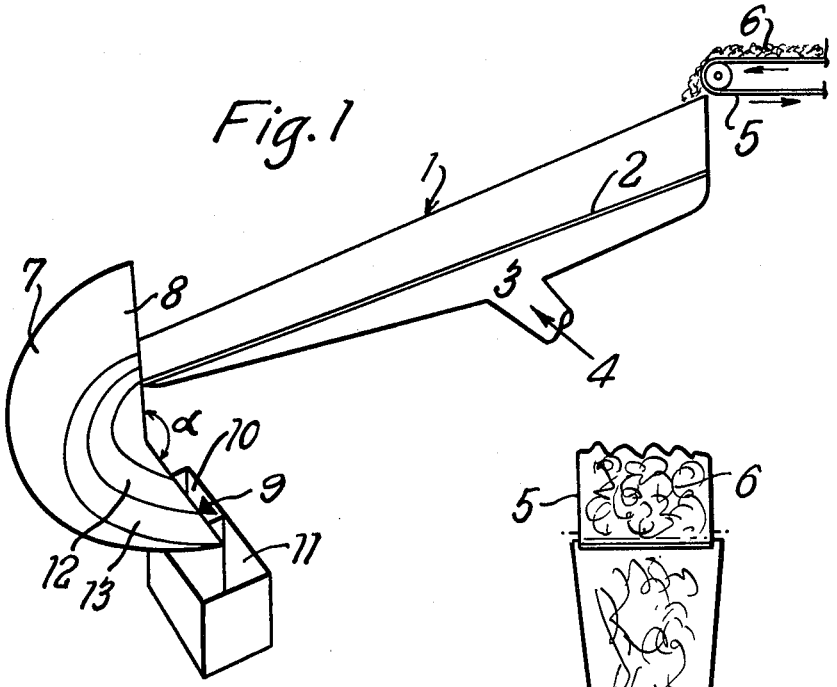

1
2
3
4
5
6
7
8
9
10
11
12
13
α

1
5
6
7
8
9
10
11
12
13

PINCHED SLUICE SEPARATORS

This invention relates to pinched sluice separators.

A wide variety of apparatus and machinery is known for the separation of granular materials into phases of different particle size, density or the like. A particular type of such apparatus is the pinched sluice in which material to be separated flows downwardly under the effect of gravity over a sluice chute which tapers inwardly towards its lower discharge end. During this travel the different density components of the material separate. In one variety of a pinched sluice separator, the floor of the chute is permeable and air is blown up through the floor to fluidise the bed of material to be separated flowing down the sluice. Such sluices are referred to as the "dry type" (to distinguish them from the wet type sluice on which the material to be separated flows down the sluice in the presence of water). Dry pinched sluice separators of this type are described in British Pat. Specification No. 1,153,722.

When using such a dry pinched sluice separator, the fluidised material being separated arrives at the lower end of the separator in a stratified form, the densest material being at the bottom and the least dense material being at the top. The stratified material is then allowed to drop in a plume from the separator and the required fraction(s) is or are collected in a hopper or hoppers below the end of the separator. The different fractions travel at different distances from the end of the sluice chute. In some instances there is provided a splitter which is arranged more accurately to split the fractions of the plume emerging from the end of the sluice and guide them into their relevant hoppers.

However it is found that in operation of such pinched sluice separators the collection of the separate fractions is less efficient than it might be; especially in the case of the separation of copper, plastics, and aluminium in granular form, e.g. chopped cable scrap. In particular it is found that some of the granulates in the dropping plume stream tend to hit the hopper walls or the splitter, if present, and bounce into the wrong hopper, thus causing inefficient separation.

According to the present invention there is provided a pinched sluice separator comprising a chute having an air permeable floor and side walls tapering towards a discharge end, the chute being provided at one of its side walls adjacent the discharge end with a concave surface such that, when the sluice is in use, material from the chute traverses the concave surface, the concave surface comprising a sector of a hollow 80°–140° cone and that part of the concave surface adjacent the discharge end of the chute being substantially at right angles to the chute floor.

In the use of the sluice of the present invention when the stream of stratified material reaches the lower end of the sluice chute, instead of being allowed to drop as in a conventional separator, the material flows across the concave surface and due to the concavity of the surface the average kinetic energy of the material stream is reduced. Also, somewhat surprisingly, there is substantially no mixing of strata as they leave the chute. Instead the material in separation crosses the surface in the form of a diverging fan and thus although the different fractions of material are moving in substantially the same direction they are moving away from one another facilitating their separate collection. Moreover since the kinetic energy of the material is reduced there is less likelihood of bouncing causing material to enter the wrong hopper.

In order to obtain best results it is generally preferred that the concave surface be such that the separated material is discharged from the surface substantially horizontally. This again results in reduced bouncing.

As mentioned above the concave surface, provided at one end of the chute side walls adjacent the discharge end, comprises a sector of a hollow 80°–140° cone. The cone configuration of the concave surface is important to achieve good results. Other curved configurations have been found to give unsatisfactory results.

Preferably the concave surface is a sector of a hollow 90–120° cone, especially 90°–110°, or even more especially 90°–100°. Most preferably however the hollow cone is a hollow at least 90° cone since this gives a satisfactory discharge direction from the concave surface. By the term "a hollow 80°–140° cone" as used herein is of course meant a hollow cone having an included angle of 80°–140°. Similarly in a hollow at least 90° cone the included angle is at least 90°. Most especially the cone has an included angle of substantially 90°. The concave surface is of course the inside surface of a sector of the hollow cone.

The preferred size of the sector in use which comprises the concave surface will depend inter alia on the speed at which material leaves the end of the chute. The material must of course leave the chute with sufficient speed to traverse the concave surface. In a preferred configuration the concave surface comprises a sector which is substantially half a hollow 90° cone. Such a surface will of course have a horizontal discharge direction.

If desired the concave surface may have a short lead-in and/or lead-out non conical surface but generally this is not necessary. It may perhaps be desirable to have a lead-out surface on the discharge edge of the concave surface to guide the separated material into a horizontal plane if it is not already in such a plane.

If desired, to collect separately the different fractions from the fan of material there may be provided at the discharge edge of the concave surface a splitter adapted to guide the fractions to their relevant hoppers. As the separated material is in the form of a fan the different fractions can usually be readily distinguished by eye. This facilitates accurate collection of the fractions.

The concave surface may most readily be provided by curved sheet material.

The invention also provides a method for the separation of granulate materials which method comprises allowing the material to be separated to flow downwardly over the chute of a separator according to the invention under the effect of gravity and fluidisation caused by gas blown through the air permeable chute floor, allowing the so separated material to traverse the concave surface of the separator and collecting at least one fraction.

Figure 2:
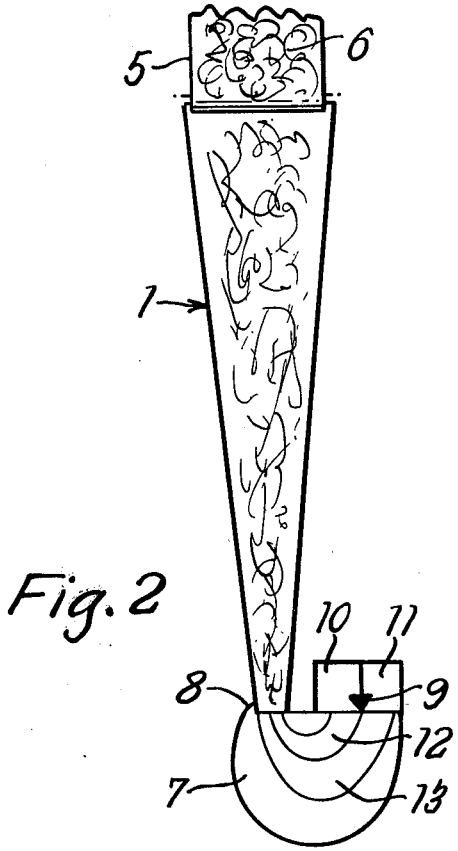

The invention is further illustrated by way of example in the accompanying drawings, wherein FIG. 1 is a diagrammatic side view of a pinched sluice separator according to the invention and FIG. 2 is a view from above of the separator of FIG. 1.

Referring to the drawings, the separator comprises a sluice chute 1 inclined and tapering inwardly towards its lower end. The chute has a permeable floor 2 and air may be blown through this floor from a plenum chamber 3, air supply being indicated at 4. At the upper end of the chute is a conveyor belt 5 for feeding material to be separated 6 into the chute. Fixed to the lower end of chute 1 is a plate 7, that part 8 of the plate adjacent the sluice being substantially vertical. Plate 7 is in the form of a sector which is half of a 90° cone. The plate 7 is attached to the chute approximately half the way down its, the plate's, side with the cone apex downwardly. Thus the angle indicated at $\alpha$ in FIG. 1 is 90° and therefore material discharged from plate 7 will be travelling substantially horizontally. At the discharge edge of plate 7 is a splitter 9 to split fractions of material discharging from plate 7 and guide it into one of two hoppers 10 or 11.

In use of the separator conveyor belt 5 feeds material 6 to be separated onto the upper end of the chute 1 and air is blown through the floor 2. Under the combined effects of gravity and the air blown through floor 2, the material to be separated runs down the chute in a fluidised stream emerging stratified at the lower end of chute 1, with the densest material at the bottom and the least dense at the top.

On emerging from chute 1 the stratified material travels across plate 7. The different fractions of the material travelling in substantially the same direction as they cross the plate but diverging slightly. Accordingly the different fractions remain separate as the materials cross the plate; the route taken by the denser material is shown in the drawings at 12 and that by the less dense material at 13. The splitter 9 is so positioned that the denser material 12 is separated from the less dense 13 and guided into hopper 10; the material 13 is guided into hopper 11. Since the kinetic energy of the material is reduced as it traverses plate 7 and also because the material leaves plate 7 travelling in substantially a horizontal direction, the amount of bouncing of material on splitter 9 into the incorrect hopper is minimised.

Clearly, the positioning of splitter 9 will depend on the particular fraction(s) desired and the nature of the material in-put. If more than two fractions are desired then correspondingly more splitters and hoppers will be required. It may for example be desired simply to collect the two outside fractions and return the central fraction for re-separation.

The different fractions of the material to be separated can be readily seen by eye. Thus for automatic working the splitter position may be controlled by an optical scanning device to ensure that it is in the optimum position.

We claim as our invention:

1. A pinched sluice separator for granular materials of differing particle size, density, or the like, comprising a chute having an air-permeable floor, a discharge end, and side walls tapered inwardly towards said discharge end;

a concave surface substantially in the form of a sector of a hollow cone with an apex angle of between about 80° and 140°;

said surface being positioned adjacent a side wall of said chute at said discharge end, with said chute floor above a portion of said concave surface, the part of said surface adjacent said side wall being substantially perpendicular to said chute floor;

whereby material passing through said chute and traversing said sector, exits therefrom in separate and diverging streams.

2. A separator according to claim 1 including a splitter arrangement associated with the discharge end of said sector to guide fractions of said material out of said surface without mixing said fractions.

3. A separator according to claim 1 wherein the exit portion of said surface is substantially horizontal, whereby material leaving said chute and traversing said sector is discharged substantially horizontally.

4. A separator according to claim 1 wherein the cone sector has an apex angle of between 90° and 120°.

5. A separator according to claim 1 wherein the concave surface is provided by curved sheet material.

6. A separator according to claim 1 wherein the cone sector has an apex angle of substantially 90°.

7. A separator according to claim 6 wherein the sector is substantially half of a cone.

8. A method for separation of granular materials into phases of different particle size or density comprising the steps of causing said materials to form a stratified generally horizontally flowing stream, with different layers having differing speeds of flow and differing densities;

guiding said stratified stream of materials along the concave surface of a sector of a cone, said surface being generally vertical at the position of entrance of said stream and generally horizontal at the position of exit of said stream;

said cone having an apex angle of between about 80° and 140°;

whereby said stratified fractions are caused to diverge in a fan arrangement; and separately collecting at least one of said fractions.

9. A method according to claim 8 wherein said materials are discharged from said surface substantially horizontally.

10. A method according to claim 8 wherein said surface is substantially half of a cone having an apex angle of substantially 90°.

* * * * *